US007294064B2

(12) United States Patent
Tsurumaki et al.

(10) Patent No.: US 7,294,064 B2
(45) Date of Patent: Nov. 13, 2007

(54) GOLF CLUB

(75) Inventors: Masaei Tsurumaki, Tsubame (JP); Katsuhiro Kobayashi, Tsubame (JP); Takayuki Ando, Tsubame (JP)

(73) Assignee: K.K Endo Seisakusho, Niigata (JP)

( * ) Notice: Subject to any disclaimer, the term of this patent is extended or adjusted under 35 U.S.C. 154(b) by 0 days.

(21) Appl. No.: 11/482,117

(22) Filed: Jul. 7, 2006

(65) Prior Publication Data

US 2007/0021234 A1 Jan. 25, 2007

Related U.S. Application Data

(63) Continuation-in-part of application No. 10/801,545, filed on Mar. 17, 2004, now abandoned.

(30) Foreign Application Priority Data

Mar. 31, 2003 (JP) ..... 2003-94639

(51) Int. Cl.
*A63B 53/04* (2006.01)

(52) U.S. Cl. ..... 473/329; 473/345; 473/349

(58) Field of Classification Search ..... 473/324–350
See application file for complete search history.

(56) References Cited

U.S. PATENT DOCUMENTS

| | | | | |
|---|---|---|---|---|
| 777,400 | A | 12/1904 | Clark | |
| 5,205,560 | A | 4/1993 | Hoshi et al. | |
| 5,213,328 | A | 5/1993 | Long et al. | |
| 6,319,149 | B1 | 11/2001 | Lee | |
| 6,348,013 | B1 | 2/2002 | Kosmatka | |
| 6,506,129 | B2 | 1/2003 | Chen | |
| 6,524,198 | B2 | 2/2003 | Takeda | |
| 6,602,149 | B1 * | 8/2003 | Jacobson | 473/329 |
| 6,695,715 | B1 | 2/2004 | Chikaraishi | |
| 6,887,165 | B2 | 5/2005 | Tsurumaki | |
| 2004/0121852 | A1 | 6/2004 | Tsurumaki | |

OTHER PUBLICATIONS

Patent Abstracts of Japan, Publication No. 2000-176056, dated Jun. 27, 2000.
Patent Abstracts of Japan, Publication No. 2001-054596, dated Feb. 27, 2001.
Patent Abstracts of Japan, Publication No. 2002-017912, dated Jan. 22, 2002.

* cited by examiner

*Primary Examiner*—Sebastiano Passaniti
(74) *Attorney, Agent, or Firm*—Westerman, Hattori, Daniels & Adrian, LLP.

(57) ABSTRACT

In a driver golf head (1) comprising a face (4) having a hitting surface, a sole (3) forming a lower portion, and a crown (5) forming an upper portion, the sole (3) is improved. The sole (3) in the position close to the face (4) was formed into an elastically deformable recess-projection shape, and part of the face (4) was formed into a projecting shape and integrated with the sole (3) to increase rigidity. Using a configuration with increased rigidity and decreased rigidity between the face (4) and sole to obtain an elastically deformable portion and providing a high-rigidity body (12) increased the repulsion force in the lower portion of the face and extended the traveling distance of the golf ball.

3 Claims, 11 Drawing Sheets t5>t6>t7=t8

FIG. 21

| Hitting Position | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Center of the face | 1 | 44.1 | 59.7 | 135 | 12.0 | 2,090 | 203 | 25 | 228 |
| | 2 | 44.1 | 59.9 | 136 | 12.0 | 1,890 | 203 | 27 | 230 |
| | 3 | 43.9 | 60.0 | 137 | 12.2 | 2,200 | 205 | 23 | 228 |
| | 4 | 43.8 | 59.8 | 137 | 12.3 | 2,200 | 207 | 23 | 230 |
| | 5 | 44.0 | 60.1 | 137 | 11.9 | 2,060 | 204 | 26 | 230 |
| | 6 | 43.9 | 59.8 | 136 | 11.8 | 2,190 | 203 | 25 | 228 |
| | 7 | 44.0 | 59.9 | 136 | 11.7 | 2,300 | 203 | 24 | 227 |
| | 8 | 43.8 | 60.0 | 137 | 12.2 | 2,070 | 205 | 25 | 230 |
| | 9 | 44.1 | 59.9 | 136 | 12.1 | 2,240 | 204 | 23 | 227 |
| | 10 | 43.8 | 60.2 | 137 | 12.1 | 2,050 | 206 | 25 | 231 |
| | 11 | | | | | | | | |
| | Ave. | 44.0 | 59.9 | 136 | 12.0 | 2,129.0 | 204.3 | 24.6 | 228.9 |

FIG. 22

| Hitting Position | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| 5 mm up from the center of the face | 1 | 43.7 | 59.2 | 135 | 13.4 | 2,060 | 207 | 22 | 229 |
| | 2 | 43.6 | 59.4 | 136 | 13.2 | 1,880 | 204 | 24 | 228 |
| | 3 | 43.6 | 59.3 | 136 | 13.5 | 1,910 | 205 | 23 | 228 |
| | 4 | 43.5 | 59.2 | 136 | 13.7 | 1,420 | 200 | 28 | 228 |
| | 5 | 43.8 | 59.1 | 135 | 13.7 | 1,920 | 206 | 23 | 229 |
| | 6 | 43.9 | 59.3 | 135 | 13.6 | 2,050 | 207 | 22 | 229 |
| | 7 | 43.7 | 59.2 | 135 | 13.9 | 1,870 | 207 | 22 | 229 |
| | 8 | 43.5 | 59.2 | 136 | 13.7 | 1,600 | 201 | 26 | 227 |
| | 9 | 43.7 | 59.4 | 136 | 13.4 | 2,040 | 206 | 22 | 228 |
| | 10 | 43.8 | 59.5 | 136 | 13.2 | 2,120 | 205 | 22 | 227 |
| | 11 | | | | | | | | |
| | Ave. | 43.7 | 59.3 | 136 | 13.5 | 1,887.0 | 204.8 | 23.4 | 228.2 |

FIG. 23

| Hitting Position | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| 5 mm down from the center of the face | 1 | 44.0 | 59.6 | 135 | 12.6 | 2,060 | 205 | 24 | 229 |
| | 2 | 43.6 | 59.6 | 137 | 12.4 | 2,000 | 203 | 25 | 228 |
| | 3 | 43.8 | 59.6 | 136 | 12.4 | 1,990 | 203 | 26 | 229 |
| | 4 | 43.9 | 59.6 | 136 | 12.4 | 2,120 | 206 | 24 | 230 |
| | 5 | 43.8 | 59.9 | 137 | 12.3 | 2,270 | 207 | 22 | 229 |
| | 6 | 43.7 | 59.6 | 136 | 12.5 | 2,120 | 205 | 23 | 228 |
| | 7 | 44.0 | 59.8 | 136 | 12.3 | 2,060 | 204 | 25 | 229 |
| | 8 | 43.9 | 59.6 | 136 | 12.3 | 2,000 | 201 | 26 | 227 |
| | 9 | 44.0 | 59.9 | 136 | 12.3 | 2,090 | 206 | 25 | 231 |
| | 10 | 44.1 | 59.8 | 136 | 12.3 | 2,070 | 203 | 24 | 227 |
| | 11 | | | | | | | | |
| | 12 | | | | | | | | |
| | Ave. | 43.9 | 59.7 | 136 | 12.4 | 2,078.0 | 204.3 | 24.4 | 228.7 |

GOLF CLUB

BACKGROUND OF THE INVENTION

1. Field of the Invention

The present invention relates to golf clubs. More particularly, the present invention relates to a golf club having a club head sole modified to expand the sweet area downward of the face surface and to increase the traveling distance of golf balls.

2. Description of the Related Art

There are various golf clubs prepared for varying conditions of golf courses. For the middle- or long-range first shot, golf clubs called "drivers" are usually used in order to extend the ball traveling distance. Because the traveling distance affects the score directly, the position of the ball impact point on the golf club head is an important factor. The hitting surface of the golf club is called "face". Under any conditions, the user usually strikes the ball on the face of the club head.

At address, the center of gravity of a driver club head as projected on the club face is located above the center of the face as seen from a direction perpendicular to the face surface. The reason for this is as follows. The club head has an approximately inverted trapezoidal or triangular configuration in terms of the face configuration, in which the upper side is wide and the lower side is narrow. Accordingly, the mass of the golf head is inevitably deviated toward the upper side. Furthermore, because a part known as "hosel", into which a shaft is to be inserted, is provided on the top of the club head, an extra mass is added to the upper side of the head.

Regarding the center of gravity, even a club head in which the center of gravity is located at a position approximately 60% from the bottom surface of the sole, in terms of the face height, for example, is called a "low-center of gravity model". A ball striking area called "sweet area" is in the vicinity of the center of gravity and is an area capable of sending the ball the farthest distance. Therefore, in order to make use of the maximum repulsion capacity of the head and to obtain a long traveling distance, it is usually necessary to strike the ball on a sweet area above the center of the face. However, not only amateur golfers whose ball impact point is likely to vary, but also professional golfers occasionally shift their ball impact point intentionally according to golf course conditions.

For example, in a head (against) wind, golfers usually hit the ball in such a manner as to produce a low ball trajectory because if it is hit in the usual manner, the ball will have to fly against the wind, resulting in a failure to get the desired ball traveling distance. In this case, the ball impact point is in a lower area of the club face. This, however, results in a decrease of the repulsive force and the ball traveling distance becomes less than that obtained by striking on the sweet area. This can be explained as follows. Because the center of gravity is located at the upper side of the face, as mentioned above, that is, because the sweet areas, which is a high-repulsion area, is in the vicinity of the center of gravity, if the impact point is off this area, repulsive force is reduced undesirably.

Under these circumstances, various methods have been suggested to enable a repulsive force comparable to that obtained at the conventional sweet area even at a lower point of the face, thereby resolving the aforesaid problems. For example, Japanese Patent Application Laid-open No. 2002-17912 disclosed a golf club in which an area of the club face is specified and a coefficient of restitution is set to minimize the decrease in ball traveling distance even at the time of offset impact. Further, U.S. Pat. No. 6,524,198 described a method wherein a weight portion is provided in the lower position of the club head or a sweet area is enlarged in the downward direction, as a method of lowering the center of gravity and consequently increasing the repulsive force at the lower point of the club face.

On the other hand, Japanese Patent Application Laid-open No. 2000-176056 disclosed a technique by which a reinforcing rib is provided on the club face and the traveling distance of the golf ball is increased, without providing extra deformation to the sole or crown at the time of impact, as a method of increasing the rigidity of the golf club. Further, Japanese Patent Application Laid-open No. 2001-54596 disclosed a method for forming a plurality of metal shells on the inner side of the head and a portion adjusting the ball sound by build-up welding on the inner wall of the side peripheral portion, thereby suppressing strains.

As has been stated above, various methods have been devised to increase the ball traveling distance under various conditions. However, the proposed methods have not yet satisfactorily solved the problems. There is still room for improvement, particularly in terms of enhancement of repulsion at a lower point off the sweet area. The above-described method where the specific area of the club face is restricted and the coefficient of restitution of the specific zone thereof is set is implemented by reducing the thickness of a specific region of the club face so that the thickness varies from the center to the peripheral edge of the face, thereby consequently enhancing the repulsion effect.

However, though the effect is obtained in specific locations, the repulsion effect cannot be reliably increased and maintained in the lower positions of the face. Decreasing the head thickness is by itself limited because it decreases rigidity and reduces thickness. If the thickness is too small, it may conversely degrade the repulsion. Furthermore, a method wherein a weight portion is provided is effective in its own way but limited under the recent tendency for club head to increase in volume.

Thus, when a club head becomes large in size, the addition of a weight portion gives rise to a new problem that the mass of the head becomes large. Further, all the aforementioned techniques of increasing the rigidity of the golf club are merely the techniques of increasing the rigidity of the entire body, and none of them has a double object of increasing the coefficient of restitution by decreasing rigidity of one part and increasing the traveling distance by increasing rigidity in the other part of the same golf club.

Further, the golf industry is a world where tradition is valued originally. Substantial changes in the configuration, weight, etc., of the club head from those of the conventional one require users to change their golf swing and so forth. This may cause the swing rhythm to be destroyed. Even if an epoch-making golf club is developed, it will take a long time for the new golf club to become established in actual practice. Therefore, in terms of golf club appearance, it is ideal to develop a golf club improved in function to satisfy golfers, without substantial change in the configuration of the presently established golf clubs.

Accordingly, it is desired to develop a golf club capable of enlarging the repulsion area, particularly, downward on the club head face, without placing specific limitations on the function of the golf club, whereby the repulsion performance is improved over the conventional one even at a lower point of the club head face as well as in the conventional sweet area, and thus the ball traveling distance can be increased with high stability even under headwind conditions.

SUMMARY OF THE INVENTION

The present invention was made in view of the above-described technical background. Accordingly, the present invention attains the following objects.

An object of the present invention is to provide a golf club such that the traveling distance is not decreased even if the ball is hit not only in the conventional sweet area, but also at a lower point.

Another object of the present invention is to provide a golf club such that when the golf club is addressed, the outer shape viewed by the player is not different from the conventional ones, and the hitting performance is improved with respect to the conventional one.

Yet another object of the present invention is to provide a golf club in which the hitting performance is improved and which can be manufactured by the processing method identical to that used for the manufacture of the conventional golf clubs.

The advantage of the golf club in accordance with the present invention is that when the golf club is addressed, the outer shape viewed by the player is not different from the conventional ones, and no psychological pressure is placed on the player.

Another advantage of the golf club in accordance with the present invention is that even if the ball flies at a low trajectory, the traveling distance is not different from that obtained when the ball is hit with the conventional sweet area.

According to the first aspect of the present invention, there is provided a golf club having a hollow golf club head, said golf club comprising:

a metallic face portion disposed at a front of said hollow golf club head and having a hitting surface for hitting a golf ball; and a body portion constituting a remaining part thereof, said body portion comprising:

a metallic sole forming a lower portion of said hollow golf club head;

a crown forming an upper portion of said hollow golf club head;

a toe forming a forepart of said hollow golf club head;

a heel forming a rear part of said hollow golf club head;

a back positioned opposite said metallic face portion to form a back part of said hollow golf club head; and a hosel to which a shaft is connected, wherein said golf club further comprises:

an elastically deformable portion which is formed in said metallic sole portion in the vicinity of the end portion of said metallic face portion and has a structure that can be deformed elastically in response to said hitting, wherein the plate thickness of said metallic sole portion is thinner than the plate thickness of said metallic face portion; and a high-rigidity portion which is disposed in said metallic sole portion on the side of said back of said elastically deformable portion for increasing the rigidity of said disposed portion and for restoring elastic deformation with repulsion force close to explosiveness.

The golf club according to a second aspect of the present invention is the golf club according to a first aspect of the present invention, wherein said elastically deformable portion comprises different members from other members which comprise said metallic sole portion.

The golf club according to a third aspect of the present invention is the golf club of the first or second aspect, wherein said elastically deformable portion is disposed in an area where the lower portion of said metallic face portion and said metallic sole are joined; and Young's modulus of material which makes said high rigidity portion is lower than Young's modulus of other material which comprises said metallic sole portion.

A golf club according to a fourth aspect of the present invention is the golf club of the first or second aspect, wherein said high-rigidity portion is a high-rigidity body which is disposed in the form of a plurality of sections.

BRIEF DESCRIPTION OF THE DRAWINGS

FIG. 21 illustrates the results relating to a ball traveling distance obtained when the ball was hit with the face; the figure shows the test value obtained when the golf ball was hit with the center of the face;

FIG. 22 illustrates the results relating to a ball traveling distance obtained when the ball was hit with the face; the figure shows the test value obtained when the golf ball was hit with the crown at a distance of 5 mm from the center of the face; and FIG. 23 illustrates the results relating to a ball traveling distance obtained when the ball was hit with the face; the figure shows the test value obtained when the golf ball was hit with the sole at a distance of 5 mm from the center of the face.

DESCRIPTION OF THE PREFERRED EMBODIMENTS

First Embodiment

Figure 1:
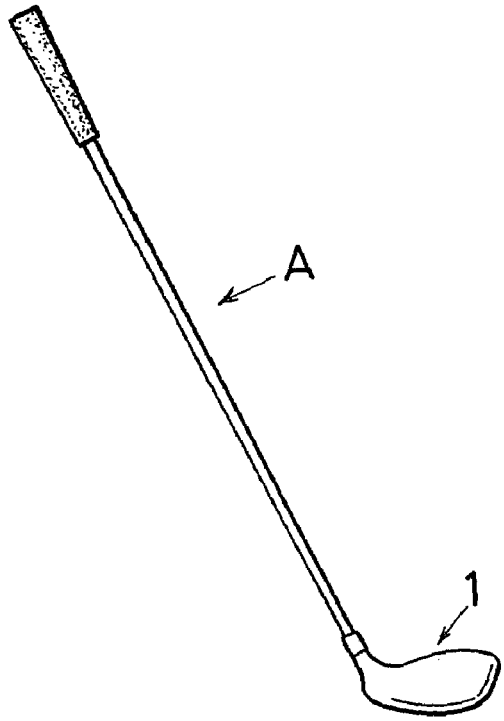
FIG. 1 is an external view showing the appearance of a golf club.
Figure 2:
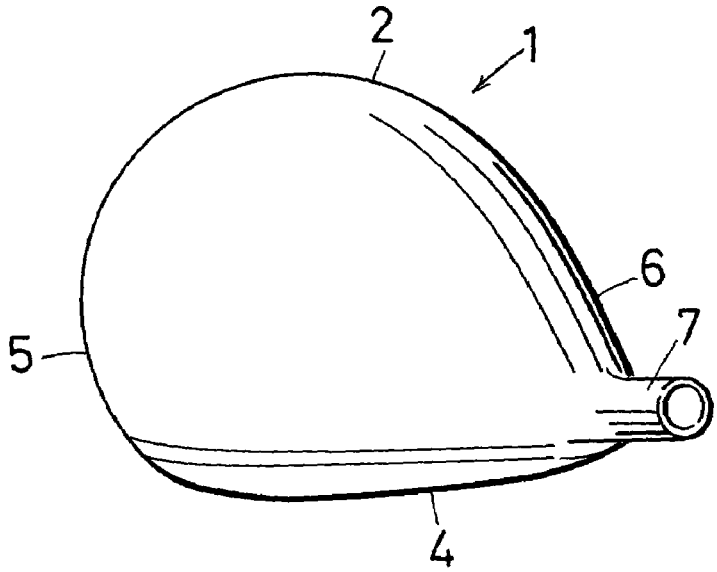
FIG. 2 is a plan view of the driver club head in accordance with the present invention.
Figure 3:
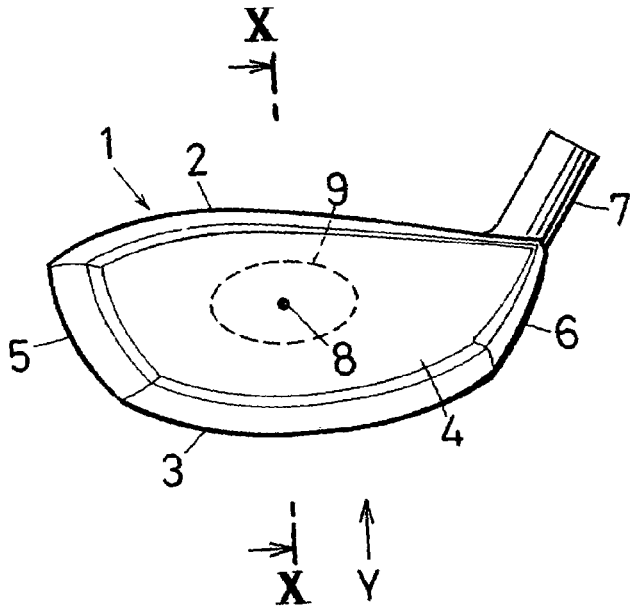
FIG. 3 is a front view of the driver club head in accordance with the present invention.
Figure 4:
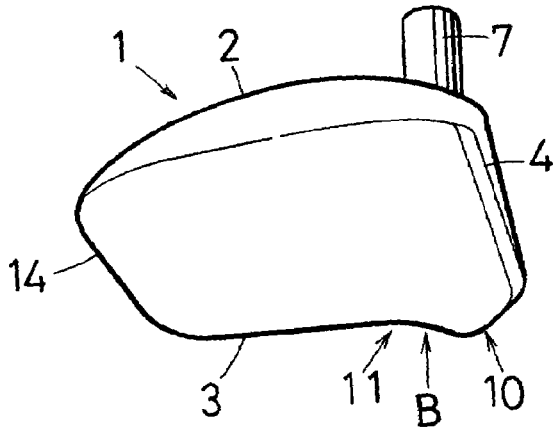
FIG. 4 is a side view of the driver club head in accordance with the present invention, which shows a first embodiment of the present invention.

FIG. 1 is an external view showing the appearance of a golf club in accordance with the present invention; this figure shows a driver club head. The golf club in accordance with the present invention is primarily a metallic hollow golf club head. In the first embodiment, the explanation will be conducted with reference to a driver club head. A driver club head 1 of the first embodiment is supported on a shaft A. FIGS. 2 to 4 show an embodiment of the driver club head 1 in the metallic hollow golf club head of the first embodiment. FIG. 2 and figures thereafter show only the head, and other members such as shaft A are omitted therein.

FIG. 2 is a plan view of the driver club head at the time the golf club is placed in an address state. FIG. 3 is a front view of the driver club head. FIG. 4 is a side view of the driver club head. As shown in the figures, the driver club head (hereinbelow referred to simply as "head") 1 comprises a crown 2 corresponding to the top portion, a sole 3 corresponding to the bottom portion, a face 4 with which a golf ball is struck, a tow 5 corresponding to the forepart of the head 1, a heel 6 corresponding to the rear part of the head 1, a back 14 corresponding to the rear part of the head on the side opposite the face 4, and a hosel 7 which is a member for supporting the driver golf head 1 on the shaft A.

In the manufacture of the head, each part comprises either a single unitized member or a plurality of parts assembled together to form one member. Each divided component part is subjected to press working and the parts are then integrated by welding or the like. For example, the golf club is composed of five divided parts as follows: a face 4, a sole 3, a crown 2, a hosel 7, and a weight. A plate material is cut into a prescribed shape, heated and press shaped. The heating temperature is 400° C. for the face 4 and 900° for sole 3, crown 2 and other portions of the body.

After press processing, the components are deburred (trimmed), followed by TIG welding. In the first embodiment, the material is a titanium alloy, and the parts are joined by butt welding the face 4 and the sole 3, then joining the hosel 7, welding, and then TIG welding the pressed members relating to the crown 2. In this way, the component parts are integrated and assembled into the driver club head 1. After the welding process, the driver golf head 1 is subjected to age hardening (5 hours at a temperature of 515° C.), grinding, followed by coating, which represent the well-known technology. Thus, the driver club head manufacture is completed.

The face 4 has a curved surface protruding outwardly and is formed form a plate-shaped material. The zone with a maximum coefficient of restitution is a sweet area 9 in the vicinity of the center 8 of gravity. Usually, an effective way of sending a golf ball a long distance is to hit the ball at the sweet area 9. Therefore, the coefficient of restitution is set high in this portion. It is well known that as the coefficient of restitution is increased, the ball traveling distance increases. The coefficient of restitution is an important factor determining the performance of golf clubs. For the coefficient of restitution, a criterion of measurement has been defined by the United States Golf Association (USGA). The coefficient of restitution is found by the following equation:

$$Vout/Vin=eM-m/M+m.$$

In the above equation, m represents the average mass of balls for testing, M represents the mass of the head, Vout represents the speed of a testing ball after impact, and Vin represents the speed of the testing ball before impact. Consequently Vout/Vin represents the speed ration. Further, e represents the coefficient of restitution. According to the definition, golf balls for testing should be Pinnacle Gold (trade name) golf balls, and testing balls that have previously been numbered and measured for initial velocity should be used. The average weight is 45.4 g.

It is regulated that the testing balls should be stored in a room at 23±1.0° C., and the impact speed should be 48.8 m/sec. In addition, a ball launching apparatus, a trajectory screen and other testing equipment have been specified in detail. Regarding a testing method also, rules have been made in detail. For example, mapping should be performed. A reference value of the coefficient of restitution is e=0.822. Whether each particular head is conformable is judged by comparing the actual impact speed ratio with the reference speed ratio on the basis of the measured mass according to the above-described definition.

The coefficient of restitution can be calculated inversely from the above-described equation, provided that the other conditions are determined. Thus, the coefficient of restitution is calculated for various values of the mass of the head that may be changed, for example, by varying the thickness of the face 4, thereby making it possible to judge optimal numerical value setting. As follows from the above-described equation, a high speed of a golf ball after impact means that the coefficient of restitution is high. A study was conducted by carrying out testing according to the above-described rules and in the first embodiment of the present invention the aforementioned conventional sweet area is shifted downward and thus widened within the range of regulated standard values.

Figure 5:
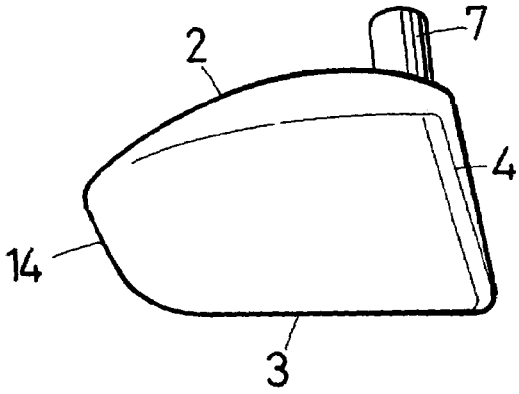
FIG. 5 is a side view of a conventional driver club head.

The first embodiment of the present invention will be described hereinbelow in greater detail. In accordance with the present invention, an elastically deformable portion which can deform elastically when a ball is hit is provided in the body portion in a vicinity of the face portion 4, and a high-rigidity for increasing the rigidity on the back side is provided in the body portion close to the elastically deformable portion. Therefore, it goes without saying that the elastically deformable portion in accordance with the present invention can be applied not only to the sole, but also to the crown, toe, and heel, but in the first embodiment the explanation will be conducted with respect to the case in which this body portion is applied to the sole. FIG. 5 is a side view of a conventional driver club head, which corresponds to a side view of the first embodiment of the present invention shown in FIG. 4.

FIG. 4 illustrates a modification example of the sole 3, wherein an elastically deformable portion which can deform elastically is provided and part of the sole 3 is made to have a high rigidity. As shown in FIG. 4, part of the sole 3 on the side of the face 4 is in the form of a projection 10 and groove 11 between the face 4 and back 14, as viewed from the side of the crown 2, thereby constituting an elastically deformable portion. The projection 10 is an area produced by relative bulging caused by the formation of a groove (also called a recess) 11. It can be also said that the groove 11 is relatively formed by the formation of the projection 10. The groove 11 comprises a gently tilted surface that can be elastically deformed. From the standpoint of external appearance, bulging is in the direction of crown 2 and the external shape becomes receded.

Figure 6:
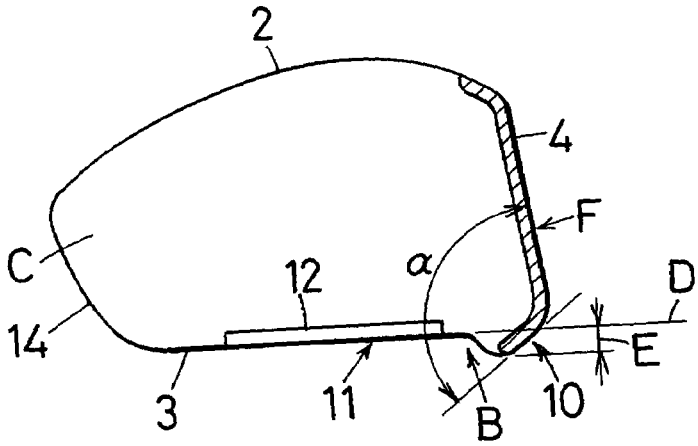
Prior Art FIG.6
FIG. 6 is a sectional view taken along the line X-X in FIG. 3, showing a first embodiment of the present invention.

The projection 10 and groove 11 form as a whole a continuous gentle curve, as shown in FIG. 4. The sole 3 on the side of face 4 is formed at the prescribed angle $\alpha$ and constitutes the projection 10 in a section taken along a vertical plane (plane containing a straight line in a direction shown by a thread suspending an object) containing a line perpendicular to the hitting surface of the face 4 (see FIG. 6). The purpose of providing a recessed and projecting area on the sole 3 is to impart an elastic effect to the sole 3. The recessed and projected area as an elastically deformable portion B is a constituent part representing a feature of the first embodiment. FIG. 6 is a sectional view taken along the line X-X in FIG. 3 and shows schematically the first embodiment.

The head 1 is a component formed by press working, as has been stated hereinabove. Accordingly a portion of the head corresponding the external line shown in the figure is defined by pressed members formed of a titanium alloy. The interior C of the head is a hollow portion. In FIG. 6, portion D shown the position of the sole of the conventional club head. In contrast thereto, in the first embodiment, part of the sole constitutes the projection 10, as shown in the figures and the sole 3 in the lower portion of the face 4 serves as an elastically deformable portion B.

The elastically deformable portion B has a structure in which part of the lower portion of the face 4 is bent, extends to the sole 3 side, and has a configuration integrated with the sole 3. The projection length (height) E of the projection 10 of the elastically deformable portion B is, for example, about 6 mm. If an impact force F acts, as shown by an arrow in FIG. 6, on the hitting surface of the face 4, the head itself undergoes complex elastic deformation. In the first embodiment, a projecting-receding elastically deformable portion B is provided in the sole 3, this configuration providing for significant concentration of elastic deformation in the sole 3.

As a result, the sole 3 produces a corresponding elastic effect even in comparison with the case of conventional configuration of face 4, for example, configuration in which the repulsion force was increased by reducing the thickness of the face 4. If the thickness of the face 4 is unreasonably intentionally decreased to increase the repulsion force, the rigidity of the head itself is reduced. The shape of the elastically deformable portion B is not limited to the aforesaid example. Any shape may be used provided that it produces an elastic effect, but the projection-recess shape is preferred.

The reason for providing such a configuration with increased hardness will be described below. As mentioned hereinabove, the configuration that can be elastically deformed due to the formation of a protrusion and a recess only in part of the sole 3 also has an increased repulsion force and provides a structure demonstrating in its own way the aforesaid effect. However, even greater effect is obtained if the repulsion force is made close to the state of explosiveness. The first embodiment makes this possible, and the configuration with increased rigidity will be explained based on FIG. 6.

In the configuration of the elastically deformable portion of the first embodiment, as described hereinabove, part of the face 4 is projected (protruded) and integrally formed on the side of the sole 3. In the projecting portion, the face 4 is bent to the side of the sole 3. Therefore, the thickness becomes somewhat larger than in the conventional configuration, the face is joined with the sole 3, and an integral shape is formed as a projection 10. The shape of the bent portion follows a gentle curve and is reinforced by the thickness identical to that of the face 4. If this projecting portion is subjected to impact of the golf ball, it deforms elastically.

As described hereinabove, providing a protrusion and a recess on the sole 3 increases the elastic force and also increased the coefficient of restitution. In the first embodiment, in addition to this configuration, a high-rigidity body 12 is provided. Under the action of a load on part of a solid body, the quantity of deformation originating in this point is proportional to the value of the load, and a physical quantity represented by the inverse value of the proportionality coefficient is called the rigidity. Therefore, a high rigidity means a small quantity of deformation of the solid body, and a low rigidity means a high quantity of deformation of the solid body.

The projecting portion deforms elastically, but because rigidity is increased by the high-rigidity body 12, the repulsion effect is further enhanced if a hitting force is received. In other words, the repulsion force becomes close to an explosiveness state and an effect of fast repulsion is demonstrated. If a hitting force is generated in the face 4, the projection and recess are deflected instantaneously due to a low rigidity thereof. Further, because the back 14 of the projecting portion is made more rigid by the high-rigidity body 12, if the hitting force is received, the back acts in the direction of instantaneously canceling the deflection caused by low rigidity and functions so as to restore rapidly the original shape of the sole 3. Therefore, the repulsion force is increased and the traveling distance of the golf ball is extended. A mode in which the high-rigidity body 12 is provided to increase rigidity and a configuration demonstrating a repulsion effect is implemented will be described below more specifically.

Figure 7:
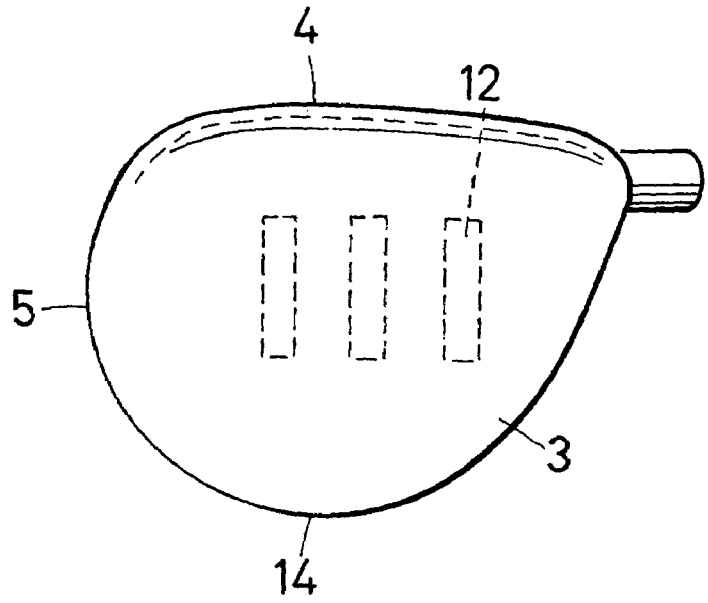
FIG. 7 is a view along the arrow Y in FIG. 3.

FIG. 7 is a view along the arrow Y in FIG. 3 and represents a bottom view of a golf club viewed from the sole 3. As shown in FIG. 6, three thin plates 12 are welded so as to reinforce the sole 3 and a high-rigidity body (high-rigidity portion) is obtained on the rear surface of the sole 3. Those three thin plates 12 are rectangular plate-like materials and are arranged parallel to each other from the back 14 toward the face 4. Due to the fixed arrangement of the thin plates 12, the high-rigidity portion provides for additional local reinforcement of the golf club locally, outside the projection 10.

Second Embodiment

Figure 8:
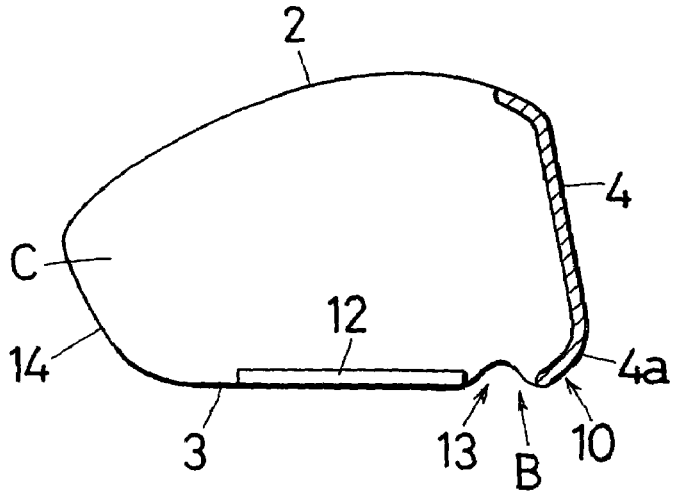
FIG. 8 is a sectional view obtained by cutting in the position identical to that in FIG. 6; it shows a second embodiment of the present invention.

FIG. 8 illustrates the second embodiment in which the shape of the sole 3 is different from that shown in FIG. 6. In the second embodiment, too, part of the face 4 has the configuration of the bent portion 4*a* identical to that in FIG. 6, projects to the sole 3 and is integrated therewith, thereby providing for increased rigidity. The difference between this configuration and that shown in FIG. 6 is that an elastically deformable groove (may be also called "recess") 13 is provided. In this configuration, the thin plates acting as a high-rigidity body are also provided on the rear surface of the sole 3, similarly to the configuration shown in FIG. 7.

Formation of a projection and a recess in the sole 3 was explained below, but those projection and recess may also have an elastically deformable shape in the form of a plurality of waves. Further, the explanation above was conducted with respect to the case where the lower portion of the face 3 was bent, but the increased rigidity may be also provided by a configuration in which a plate-like member other than the face 3 was welded. Moreover, it goes without saying that the first embodiment may be applied outside the sole 3, that is, in the crown 2, toe 5, and heel 6, as described hereinabove.

The crown has a shape such that in a section taken along a vertical plane containing a line perpendicular to the hitting surface, it is convexly projected toward the upper portion when the golf club is placed in an address state. In the same state, the toe 5 is convexly projected form the central portion of the body to the outside. In the same state, the heel 6 is convexly projected from the central portion of the body to the outside. When a high-rigidity body is disposed outside the sole 3, the body in the vicinity of the face 3 may also constitute an elastically deformable configuration, in the same manner as in the case of application to the sole 3.

Detailed Explanation of Elastically Deformable Portion B

Figure 9:
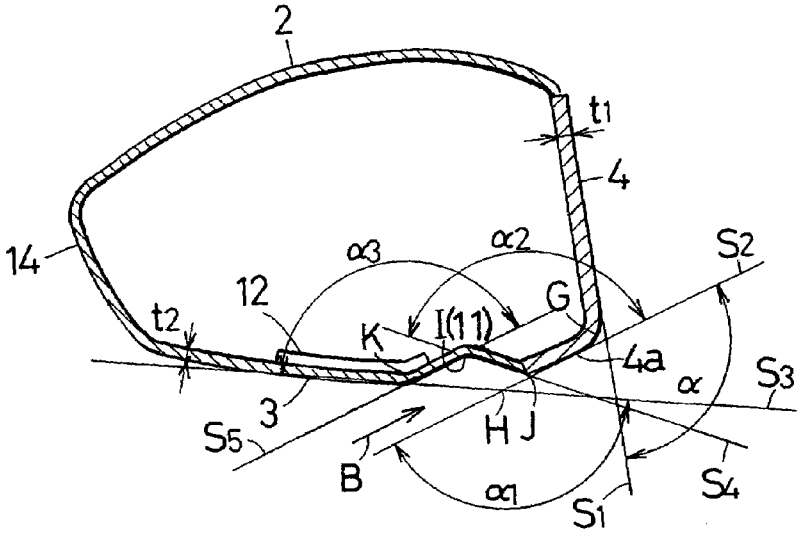
FIG. 9 is a sectional view showing the details of the structure shown in FIG. 6.

FIG. 6 is a schematic view of the X-X section of FIG. 3, and FIG. 9 is a detailed view thereof. To deepen the understanding, the configuration of the elastically deformable portion B will be described hereinbelow in greater detail based on FIG. 9. As has been stated above, the face 4 is bent at a lower portion thereof toward the sole 3 to form a bent portion 4*a* serving as part of the sole 3. The curving part between the face 4 and the bent portion 4*a* constitutes a first bend G.

The first bend G means a part formed by intersection of a line S1 tangent to the hitting surface of face 4 approximately at the center thereof with a line S2 tangent to the bent portion 4*a* approximately at the center thereof. The bend G is defined by a gently curved surface at the intersection point, and the angle α of this intersection is 90 degrees or more. The angle α of the bend G is not less than 90 degrees and not more than 135 degrees. Preferably, the angle is not less than 90 degrees and not more than 120 degrees. This has been configured by the inventor on the basis of measured data. This angle is measured by using a protractor. The hitting surface of the face 4 is rounded approximately uniformly. Therefore, when the protractor is applied (in other words, when a tangent is drawn), the measured gap between he straight line and the curved line is approximately the same at the left and right sides. The bent portion 4*a* as bent constitutes a part of the sole 3.

The sole 3 is joined at the face 4 side thereof to the distal end of the bent portion 4*a*, the joint portion forms a curve and constitutes a second bend H. The shape shown in the figure is such that part of the sole 3 has a recessed shape projecting in the direction of crown 2, but a configuration without a recess is also possible. This second bend H is gently formed by intersection of a line S2 tangent to the bent portion 4*a* and a line S3 tangent to the surface of the sole 3 approximately at the center thereof. The angle α1 thereof is an obtuse angle of not less than 90 degrees. The second bent H is virtually located. In the case illustrated by FIG. 9, part of the sole 3 constitutes a recess. Therefore, it does not represent an actual state.

The plate thickness t2 of the sole 3 is less than the plate thickness t1 of the face 4. Further, in the second embodiment shown in the figure, an arch-shaped groove I (11) is provided in sole 3, this groove being defined by a gently curved line extending immediately from the end portion of the sole 3. The arch-shaped groove I forms a continuous gently curved line. A third bend J is formed between part of the arch-shaped groove I and the bent portion 4*a*. The bent J is formed as a gentle bend by intersection of the line S2 tangent to the bent portion 4*a* with a line S4 tangent to approximately one rising portion of the groove I. The angle α2 thereof is an obtuse angle no less than 90 degrees.

Further, the groove I constitutes a continuous gently curved fourth bend K in combination with part of the surface of the sole 3 on the side of the back 14. The fourth bend K is formed as a gentle bend by intersection of a line S5 tangent to approximately one rising portion of the groove I on the side of the back 14 with a line S3 tangent to the sole 3. The angle α3 of this bend is an obtuse angle not less than 90 degrees. Each of the bends, including the groove I, constitutes a part of the elastically deformable portion B. With such a configuration of the elastically deformable portion B, a high-rigidity state can be maintained as in the conventional configuration within the range conforming to standards, without decreasing the thickness on the side of the face 4. By contrast, the rigidity on the side of the sole 3 is made lower than that on the side of the face 4.

In the configuration shown in FIG. 9, one arch-shaped groove (recess) I is provided, but a plurality thereof may be also provided. In other words, the cross-sectional shape shown in FIG. 9 is as follows. Assuming that the angle (α) of clockwise rotation from the tangent line S1 to the tangent line S2 is a plus angle and the angle (α) of counterclockwise rotation is a minus angle, the rotation angle (α) changes between plus and minus sequentially: the angle (α) is plus in rotation from the tangent line S1 to the tangent line S2, plus in rotation from the tangent line S2 to the tangent line S4, minus in rotation from the tangent line S4 to the tangent line S5, and plus in rotation from the tangent line S5 to the tangent line S3. Thus, a single continuous plus-minus change from the tangent line S1 to the tangent line S3 means that one recess is formed. Two changes mean that two recesses are formed. In the embodiment shown in FIG. 9, the angle change between plus and minus is within 90 degrees, This means that the recess is a concave groove having a gentle curvature. If there is no angle change form plus to minus, the configuration has no recess.

The crown 2 has the same shape as in the conventional club head. On the side of the face 4, the external appearance of the crown looks unchanged as seen from the player when the golf club is addressed. Because the rigidity on the side of the sole 3 is made lower than that on the side of the face 4, the lower portion of the face 4 is easily deflectable upon hitting a golf ball. With the gently curved structure, the shock is lessened, the likelihood of the head 1 being cracked at impact is eliminated, and the spring effect is enhanced. Consequently, the conventional sweet area extends toward the sole 3. In other words, the sweet area widens downward and the repulsion effect is enhanced.

If a golf ball is struck at a lower point of the face 4 (at a position below approximately 60% of the face 4 from the sole 3), the lower portion of the of the surface of the hitting surface of the face 4 is deflected and the repulsion effect is enhanced by a spring effect produced by the deflection of the sole 3 through the gently curved portion and the groove. As a result, the golf club of the first embodiment enables the conventional sweet area to extend downward on the surface of the face 4. Therefore, the sweet area is widened. Accordingly, even if a golf ball is hit at a lower poring on the face 4, there will be no decreases in ball traveling distance as occurs with the conventional golf clubs and a larger traveling distance is obtained with high stability. Further, because the sweet area is widened, a configuration with maximized coefficient of restitution is obtained. Furthermore, in the first embodiment, in addition to the above-described configuration, a high-rigidity body 12 is provided on the rear surface of the sole 3. As a result, the golf club 1 has a high-rigidity, elastically deformable configuration. This configuration can improve hitting performance.

Figure 10:
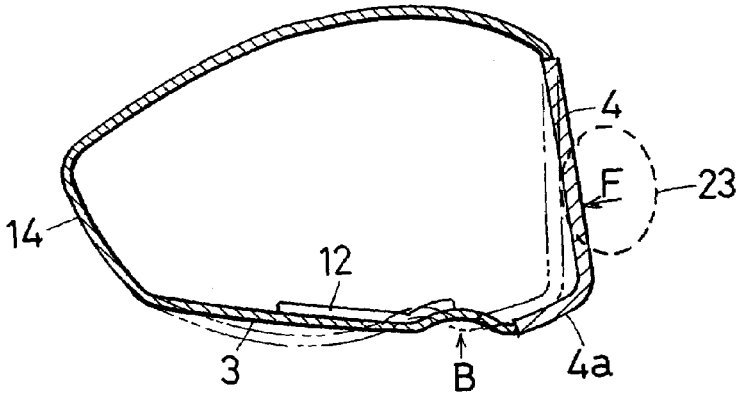
FIG. 10 is an explanatory view illustrating a state where a golf ball has been struck of the face of the club head.

FIG. 10 is an explanatory drawings schematically showing a state where a ball has been struck on the hitting source of the face 4. This is the hitting state of the golf ball in the position F shown in FIG. 6. The theoretical contents of the above-described configuration will be explained below in detail with reference to FIG. 10. When a ball 23 is struck on the face 4, the face 4 and sole 3 are deformed toward the back 14, as shown by a double dot-dash line in FIG. 10. The ball 23 is also deformed. If the amount of deformation of the gall 23 is reduced, the hysteresis loss due to deformation of the ball 23 when it returns to the previous spherical shape by its own elasticity is reduced, and thus the impact energy loss of the ball 23 is minimized. If the amount of deformation of the face 4 is increased, the amount of deformation of the ball 23 can be reduced relatively. Consequently, it is possible to increase the coefficient of restitution and to hit the ball 23 to a longer distance.

The sole 3 is also deformed downward following the deformation of the face 4 caused by a strike. In the conventional club head, the angle formed between the face 4 and the sole 3 is an acute angle, as shown in FIG. 5. Therefore, the face 4 and the sole 3 are not sufficiently deformable. However, in the first embodiment, the angle between the face 4 and the sole 3 is set to not less than 90 degrees, as shown by the aforesaid bend G. As a result, the face 4, particularly a region below the center of the hitting surface thereof, is lower in rigidity than in the conventional club head and hence easily elastically deformable upon hitting the ball. Thus, the lower portion of the face 4 is elastically deformed to an extent greater than that of the conventional club by a synergetic effect of the face 4 and the sole 3. At the same time, because a high-rigidity body 12 of the sole 3 is disposed, this portion participates in rapid repulsion. For this reason, when the ball is struck on the hitting surface in the downward direction of the face 4, the traveling distance of the ball 23 is extended effectively without lowering the coefficient of restitution in comparison with the conventional club head.

Third Embodiment

Figure 11:
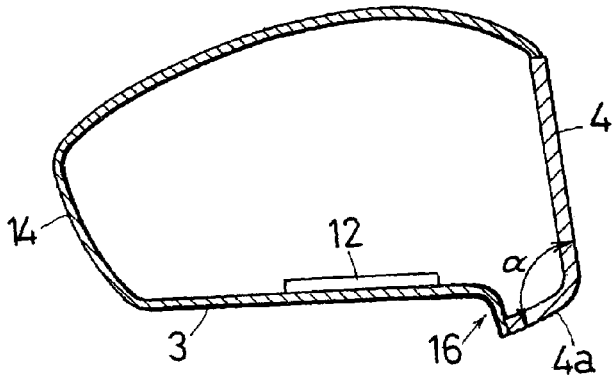
FIG. 11 is a cross-sectional view showing a third embodiment of the present invention.

FIG. 11 shows a third embodiment of the present invention, which represents a modification example of the joint portion of the sole 3 from the bent portion 4*a*. In this embodiment, a bend 16 having a bend surface almost parallel to the hitting surface of the face 4 is formed in the joint portion. The sole 3 extending from the bend 16 to the back 14 is approximately flat and in a straight-line form in the sectional view of the figure. When an impact is received by the face 4, the bend 16 is deformed to a considerable extent.

Fourth Embodiment

Figure 12:
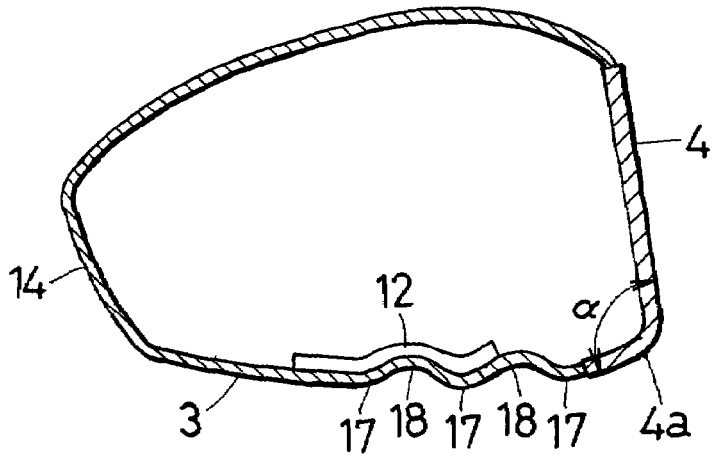
FIG. 12 is a cross-sectional view showing a fourth embodiment of the present invention.

FIG. 12 shows a forth embodiment of the present invention. In this case, the sole 3 on the side of the face 4 is formed with a plurality of projections and recesses in the sole 3 on the side of the face 4 in a section taken along a vertical plane containing a line perpendicular to the hitting surface of the face 4 when the golf club is addressed. Such a configuration is based on the assumption that the bend with the sole 3 is formed at an obtuse angle $\alpha$. As shown in FIG. 12, there are three projections 17 and two grooves 18. The repulsion effect is the same as above, but the recessed and projected shape is somewhat smaller than in the above-described examples owing to the restriction on the space.

Fifth and Sixth Embodiments

Figure 13:
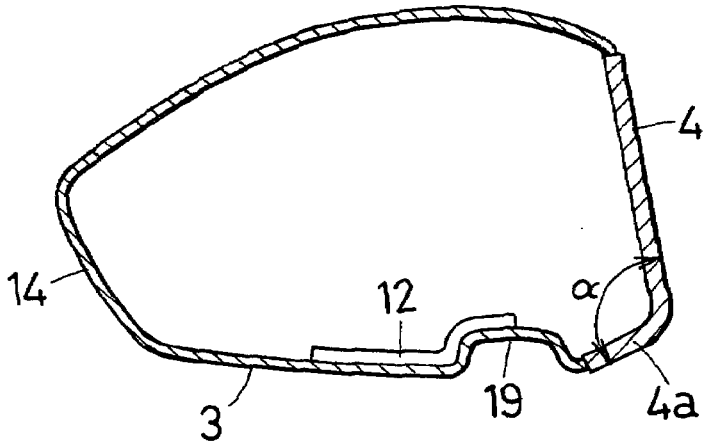
FIG. 13 is a cross-sectional view showing a fifth embodiment of the present invention.
Figure 14:
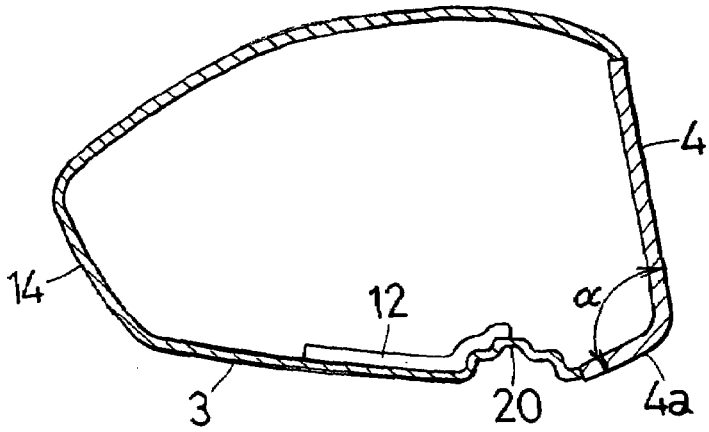
FIG. 14 is a cross-sectional view showing a sixth embodiment of the present invention.

FIG. 13 shows the fifth embodiment of the present invention, this example illustrating a modification of the groove I (11). In this case, the groove 19 has an arch-shaped rectangular configuration. FIG. 14 shows the sixth embodiment of the present invention. This example, too, illustrates a modification of the groove I (11). In this case, the groove 20 has a rectangular arch-shaped configuration forming a step. Both embodiments provide the same effects as described above.

Seventh Embodiment

Figure 15:
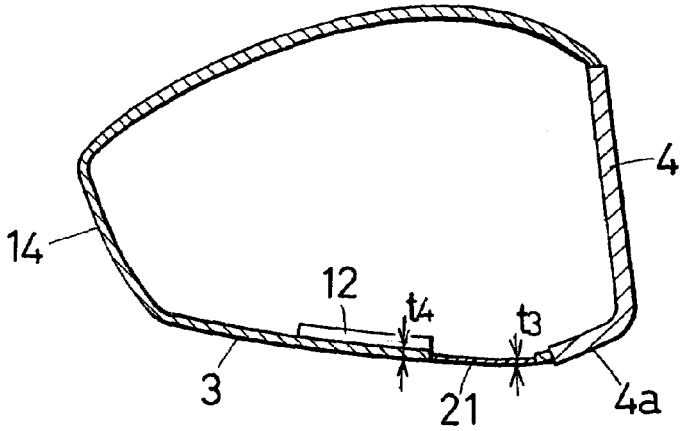
FIG. 15 is a cross-sectional view showing a seventh embodiment of the present invention.

FIG. 15 shows the tenth modification in which the rigidity of the sole 3 was reduced. In this embodiment, the rigidity of the sole was decreased by making the plate thickness t1 of the thin plate 21 which is part of the sole 3 less than the plate thickness t2 of the other portions.

Eighth Embodiment

Figure 16:
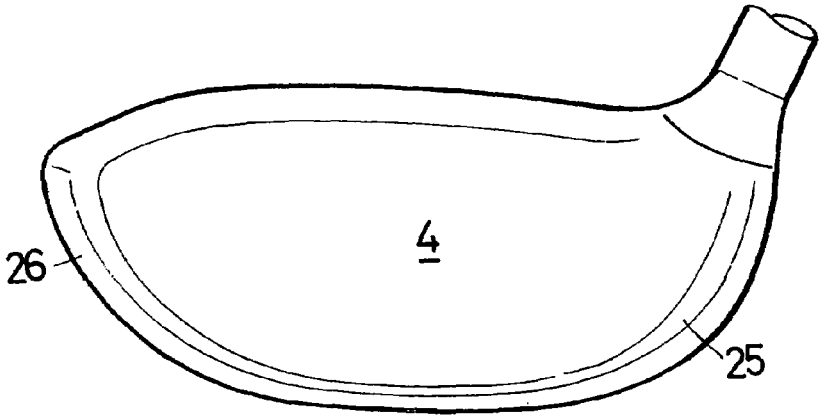
FIG. 16 is a front view of the driver club head showing the eighth embodiment of the present invention.
Figure 17:
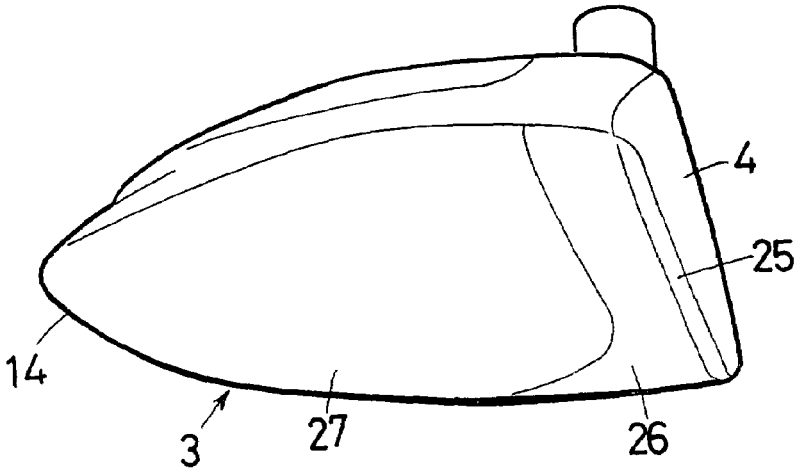
FIG. 17 is a side view of the driver club head showing the eighth embodiment of the present invention.
Figure 18:
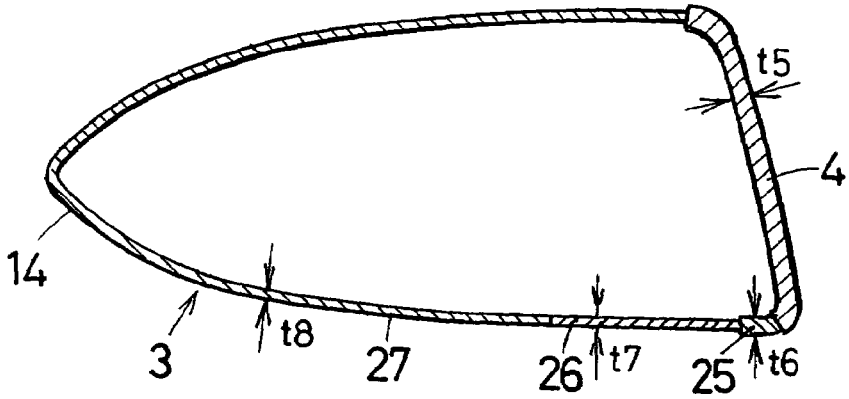
FIG. 18 is a sectional view showing the eighth embodiment of the present invention.

FIGS. 16, 17 and 18 shows the seventh embodiment of the present invention. FIG. 16 is a front view of the driver club head showing the eighth embodiment. FIG. 17 is a side view of the driver club head showing the eighth embodiment. FIG. 18 is a sectional view showing the eighth embodiment.

The face portion 4 is the plate material made up of titanium alloy, and has the plate thickness t5. The bottom flange 25 is welded to the outline of the bottom of the face portion 4. The bottom flange 25 is the plate material made up of titanium alloy, and has the plate thickness t6. In this embodiment, it is the plate thickness t5>the plate thickness t6.

Further, the low-rigidity sole portion 26 which is elastically deformed more than other portion is disposed being unified by weld in the sole portion 3 of the back 14 side of the bottom flange 25. The low-rigidity sole portion 26 is the plate material made up of titanium alloy, and has the plate thickness t8. In this embodiment, it is the plate thickness t7>the plate thickness t8. That is, in this embodiment, t5>t6>t7=t8. Young's modulus of the low-rigidity sole portion 26 is about 80~90 GPa in this embodiment. Young's modulus of the back side of the sole portion 27 is about 105 GPa. Therefore, when the golf ball is struck on the face portion 4, the hitting force is transferred to the bottom flange 25, the low-rigidity sole portion 26, and the back side of the sole portion 27.

In this embodiment, Young's modulus of the face portion 4 and the bottom flange 25 is 105~120 GPa, and Young's modulus of the low-rigidity sole portion 26 is lowest.

Although various embodiments have been described above, the present invention is not necessarily limited to the described embodiments. The elastically deformable portion and high-rigidity body were explained mainly with respect to the case where they were provided in the sole. However, it goes without saying that they can be provided over the entire body. Furthermore, a common feature of all the examples, which was not described for each embodiment separately, is that the high-rigidity body is provided in addition to the elastically deformable portion. The elastically deformable portion B preferably has the above-described recess-projection shape, but it may also have a gentle V-shaped configuration or a bellows-like configuration. The elastically deformable portion B may have any configuration, provided that it enhances the elastic effect and lowers the rigidity.

EXAMPLES

Figure 19:
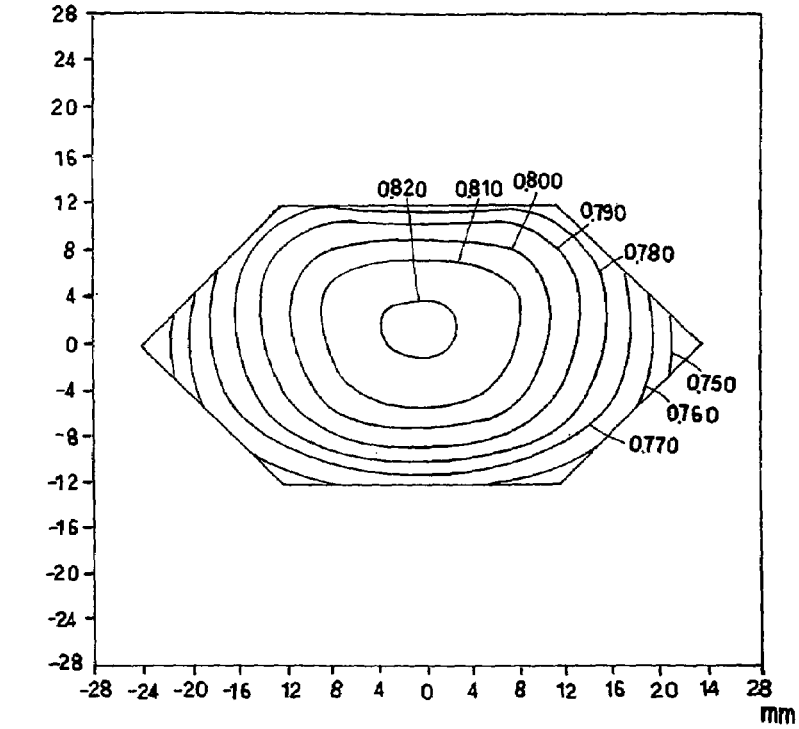
FIG. 19 is a diagram showing the distribution of coefficients of restitution in the club head of the embodiment in which a thin plate is provided on the rear surface of the sole.
Figure 20:
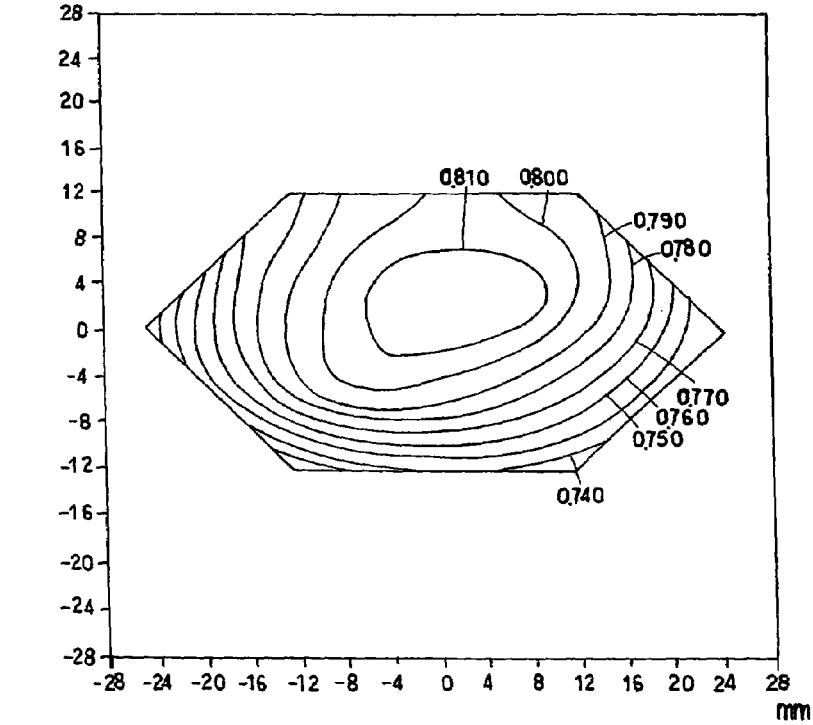
FIG. 20 is a diagram showing the distribution of coefficients of restitution in the club head of a conventional configuration.

The following is a description of examples carried out as experiments to examine the improvement in performance with regard to the above-described configurations. FIG. 19 shows the results of an experiment carried out on the golf club according to the sixth embodiment. In this experiment, a plate with a weight of 4 to 5 g was welded as a high-rigidity body to the rear surface of the sole. This figure shows a distribution of coefficients of restitution measured when a golf ball was struck on the face 4. Based on the experimental result, positions with the same coefficient of restitution were plotted as contour lines. FIG. 20 shows the results of an experiment carried out on a conventional golf club under the same conditions as in the case illustrated by FIG. 19. The experiments were carried out under the following conditions.

Face material: cold rolled stock of Ti-15V-3Cr-3Sn-3Al, plate thickness 2.9 mm.

Sole material: Ti-15V-3Cr-3Sn-3Al, plate thickness 1.15 mm.

Crown material: Ti-15V-3Cr-3Sn-3Al, plate thickness 1.0 mm.

Volume: about 420 cc, mass: about 195 g.

Loft angle β: 10.5 degrees

Lie angle γ: 56.5 degrees.

In the experimental examples, the maximum coefficient of restitution in the example shown in FIG. 19 was 0.8214, whereas the maximum coefficient of restitution in the conventional example relating to data shown in FIG. 20 was 0.8199. Furthermore, conducting the comparison under the same conditions clearly demonstrates that among the data shown in FIG. 19, high values of the coefficient of restitution are distributed closer to the sole side than in FIG. 20. Thus, this means that even if a golf ball is struck at a point on the face surface close to the sole, the ball can be hit a farther distance than with the conventional golf club. Therefore the effect of the configurations of the above-described embodiments is clearly demonstrated.

FIGS. 21 to 23 show a data diagram illustrating he traveling distance obtained by varying the hitting portions on the face, those data relating to the embodiment configuration illustrated by FIG. 19. The loft angle is 9.25 degrees and the head mass is 208.4 g. FIG. 21 relates to the case in which the golf ball was hit with the center of the face; the average traveling distance is 228.9 yards. FIG. 22 relates to the case in which the golf ball was hit in a point 5 mm closer to the crown from the center of the face; the average traveling distance is 228.2 yards. FIG. 23 relates to the case in which the golf ball was hit in a point 5 mm closer to the sole from the center of the face; the average traveling distance is 228.7 yards. No significant difference in the traveling distance was observed between the hitting positions. Thus, no decrease in the traveling distance is observed even when the golf ball is hit in the lower portion closer to the sole from the face center.

What is claimed is:

1. A golf club having a hollow golf club head, said golf club comprising:

a metallic face portion disposed at a front of said hollow golf club head and having a hitting surface for hitting a golf ball; and a body portion constituting a remaining part thereof, said body portion comprising:

a metallic sole forming a lower portion of said hollow golf club head;

a crown forming an upper portion of said hollow golf club head;

a toe forming a forepart of said hollow golf club head;

a heel forming a rear part of said hollow golf club head;

a back positioned opposite said metallic face portion to form a back part of said hollow golf club head; and a hosel to which a shaft is connected, wherein said golf club further comprises:

an elastically deformable portion which is formed in said metallic sole portion in the vicinity of the end portion of said metallic face portion and has a structure that can be deformed elastically in response to said hitting, wherein the plate thickness of said metallic sole portion is thinner than the plate thickness of said metallic face portion; and a high-rigidity portion which is disposed in said metallic sole portion on the side of said back of said elastically deformable portion for increasing the rigidity of said disposed portion and for restoring elastic deformation with repulsion force close to explosiveness, wherein said elastically deformable portion is disposed in an area where the lower portion of said metallic face portion and said metallic sole are joined, and Young's modulus of material which makes said high rigidity portion is lower than Young's modulus of other material which comprises said metallic sole portion.

2. The golf club according to claim 1, wherein said elastically deformable portion comprises different members from other members which comprise said metallic sole portion.

3. The golf club according to claim 1 or 2, wherein said high-rigidity portion is a high-rigidity body which is disposed in the form of a plurality of sections.

* * * * *